US005743206A

United States Patent [19]

Hattori

[11] Patent Number: 5,743,206

[45] Date of Patent: Apr. 28, 1998

[54] HULL FOR SMALL WATERCRAFT

[75] Inventor: Toshiyuki Hattori, Shizuoka, Japan

[73] Assignee: Yamaha Hatsudoki Kabushiki Kaisha, Shizuoka, Japan

[21] Appl. No.: 800,843

[22] Filed: Feb. 14, 1997

[30] Foreign Application Priority Data

Feb. 14, 1996 [JP] Japan ..... 8-026717

[51] Int. Cl.[6] ..... B63B 35/73

[52] U.S. Cl. ..... 114/270; 440/89

[58] Field of Search ..... 114/270; 440/38, 440/89

[56] References Cited

U.S. PATENT DOCUMENTS 4,986,208 1/1991 Kobayashi .

FOREIGN PATENT DOCUMENTS

| | | | |
|---|---|---|---|
| 18193 | 1/1990 | Japan | 114/270 |
| 85091 | 3/1990 | Japan | 114/270 |
| 6-80094 | 3/1994 | Japan . | |
| 6-191466 | 12/1994 | Japan . | |

*Primary Examiner*—Jesus D. Sotelo

*Attorney, Agent, or Firm*—Knobbe, Martens, Olson & Bear, LLP

[57] ABSTRACT

An improved hull for watercraft provides a secondary access port to an engine compartment. The secondary access port facilitates service or maintenance of certain engine components (e.g., spark plugs) which are hard to reach from the main access port, whether due to distance from the main access port, angle of approach through the main access port, or obstruction of reach by other watercraft components. The hull design also provides enhanced lift of the watercraft, during initial acceleration, to a cruising position up on plane, and better control during sharp, high speed turns.

38 Claims, 10 Drawing Sheets

HULL FOR SMALL WATERCRAFT

BACKGROUND OF THE INVENTION

1. Field of the Invention

The present invention relates in general to small motorized watercraft, and in particular to hulls for such watercraft.

2. Description of the Related Art

Personal watercraft have become popular in recent years. This type of watercraft is sporting in nature; it turns swiftly, is easily maneuverable, and accelerates quickly. A personal watercraft today commonly carries one rider and possibly one or two passengers.

A relatively small hull of the personal watercraft, comprising an upper deck and a lower hull, commonly defines a riders' area above an engine compartment. An internal combustion engine frequently powers a jet propulsion unit in a tunnel formed on the underside of the watercraft hull, which propulsion unit propels the watercraft. The engine lies within the engine compartment, below the riders' area. The engine is generally accessed by removal of a panel in the hull, which is typically part of the riders' seat.

The sporting nature of the personal watercraft dictates a relatively small hull for maneuverability, while at the same time demanding a fairly powerful engine. Additionally, an expansion chamber within the exhaust system is required to cool exhaust fumes and reduce noise prior to expulsion from the watercraft. Accordingly, the engine compartment defined within the hull tends to be rather tightly packed. Servicing the engine within the tight confines of the hull is consequently difficult. Little room is left for hands and tools to reach the various engine components, including those that require routine maintenance.

In prior hull designs, hull lip is generally formed at a sealed juncture of the upper deck and the lower hull. This lip, surrounding the watercraft, tends to be submerged when the watercraft is at rest and when turning. In order to maintain stability during sharp turns, especially at higher speeds, a rider leans the watercraft into the turn. The lip on the inside of the turn often dips below the water level. At higher speeds, however, the watercraft hydroplanes such that the lip is generally above the surface of the water.

SUMMARY OF THE INVENTION

A need exists for a watercraft with a hull which facilitates access to components of the engine, and particularly to components that require routine maintenance.

In accordance with one aspect of the present invention, a small watercraft is provided with a hull. The hull comprises at least two footrests and a pedestal defining a rider area. The pedestal comprises two side walls bridged by a seat. The hull defines an enclosed space below the seat. At least one of the side walls includes a maintenance port which communicates with the enclosed space in order to provide access to the enclosed space.

In accordance with another aspect of the present invention, a small watercraft includes a hull, which hull defines an engine compartment. An internal combustion engine is housed within the engine compartment. The engine includes an engine body and at least one spark plug. The spark plug is removably attached to the engine body, capable of moving along a plug insertion axis. The hull includes a maintenance port which opens into the engine compartment at a point proximate to the spark plug. The maintenance port is characterized by an axis suitably aligned with the plug insertion axis, thereby facilitating removal on insertion of the spark plug.

In accordance with an additional aspect of the present invention, a small watercraft is provided. The watercraft includes a hull defining an engine compartment, and an engine housed within the engine compartment. The hull includes a primary access port which communicates with the engine compartment and has a primary port axis. The hull also includes a secondary access port which communicates with the engine compartment and has a secondary port axis. The secondary port axis is oriented such that it is non-parallel to the primary port axis.

Another aspect of the present invention involves the recognition that the lip formed in a watercraft hull causes undesirable drag on the watercraft. For example, during initial operation from rest, the lip of the hull is commonly submerged and caused drag until the watercraft is up on plane. Such drag reduces acceleration and therefore delays the time it takes for the watercraft to get up on plane. Additionally, during a banked turn, the lip on the inside of the turn dips below water level. Water flows into the recess defined by the lip, both on the side and aft of the hull. The aft portion of the lip consequently increases the drag as the watercraft is in the banked turn.

Accordingly, another aspect of the invention involves a small watercraft comprising a hull with a bow portion and a stern portion. At least the stern portion of the hull has a convex lip. A downward-facing open recess is defined by the lip. At least one lip insert is positioned at least partially within at least a portion of the recess to channel the water flow within the recess in a manner reducing drag on the watercraft when part of the recess is submerged.

In accordance with still another aspect of the present invention, a small motorized watercraft is provided with a hull. The hull includes at least one side edge, which defines at least in part a channel opening downward. A portion of the channel is tapered from a fore end to a relatively more shallow aft end, thereby causing a downward component water traveling through the recess during watercraft operation.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS OF THE INVENTION

Figure 1:
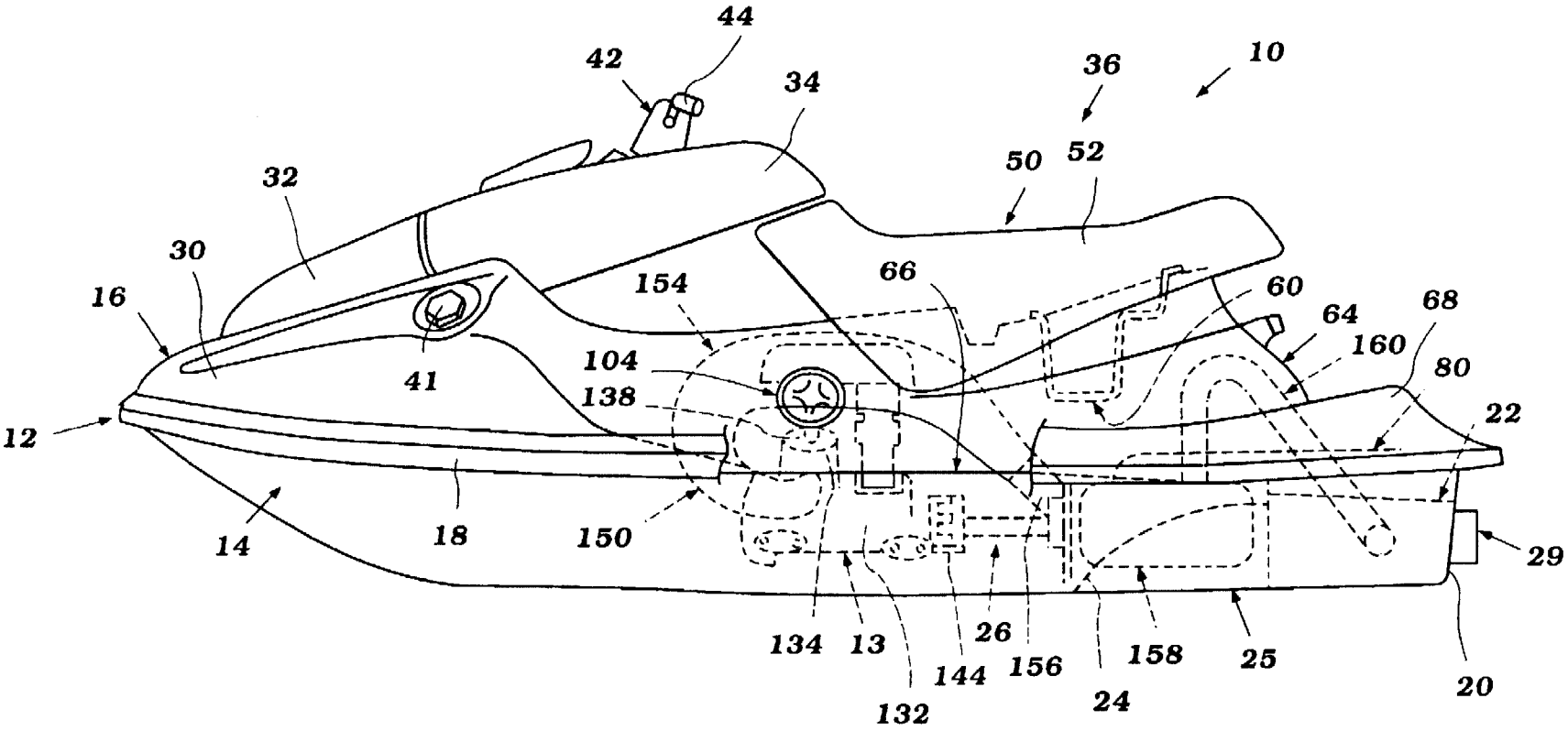
FIG. 1 is a side elevational view of a personal watercraft including an upper deck, a lower hull, and an access opening, in accordance with a preferred embodiment of the present invention, and illustrates an engine and an exhaust system of the watercraft in phantom.

The preferred embodiments are disclosed herein in the context of an exemplary personal watercraft. The embodiments employ the same basic concepts characteristic of the improved features of the watercraft hull, namely an arrangement to improve access to engine components housed within the hull and an arrangement to reduce hull drag upon initial operation from rest and during sharp turns. It will be understood, however, that advantages of various aspects of the present invention may be present individually or in combination in other embodiments. Furthermore, the basic concepts can be readily adapted by those skilled in the art for use with other types of watercraft as well. For example, but without limitation, the features of the improved hull design disclosed herein may be adapted to small jet boats and the like.

FIGS. 1 to 8 illustrate a personal watercraft 10 in accordance with a preferred embodiment. The watercraft 10 generally comprises a hull 12 housing an engine 13. The hull 12 is formed by a lower hull section 14 and an upper deck section. The upper deck is generally indicated by the reference numeral 16. The hull sections 14, 16 are formed of a suitable material such as, for example, a molded fiberglass reinforced resin. The lower hull section 14 and the upper deck section 16 may be fixed to one another in any suitable fashion. Desirably, the lower hull 14 and upper deck 16 are attached at or about a peripheral side wall or gunnel 18, as is described below with reference to FIGS. 6A–6D and 7.

The lower hull 14 is designed such that the watercraft 10 planes or rides on a minimum surface area of the aft end of the lower hull 14 in order to optimize the speed and handling of the watercraft 10 when up on plane. For this purpose, the lower hull section generally has a V-shaped configuration formed by a pair of inclined sections that extend outwardly from the keel line to outer chines at a dead rise angle. The inclined sections extend longitudinally from the bow toward a transom 20 of the lower hull 14 and extend outwardly to side walls of the lower hull 14. The side walls are generally flat and straight near the stern of the lower hull and smoothly blend towards the longitudinal center of the watercraft at the bow. The line of intersection between the inclined section and the corresponding side wall form the outer chines of the lower hull section.

Toward the transom 20, the inclined section of the lower hull extends outwardly from a recessed channel or tunnel 22 that extends upward toward the upper deck portion 16. The tunnel 22 has a generally parallelepiped shape and opens through the rear of the transom 20 of the watercraft 10, as seen from FIG. 1.

In the illustrated embodiment, a jet pump unit is mounted within the tunnel 22 on the underside of the lower hull 14 by a plurality of bolts. A curved duct 24 of the jet pump unit defines a water inlet port 25 that opens into a gullet of the duct. The duct gullet leads to an impeller housing in which an impeller shaft 26 operates. The impeller shaft 26 drives an impeller 27 within the housing. The housing narrows at a downstream end into a discharge nozzle 28. A steering nozzle 29 is supported at the downstream end of the discharge nozzle 28 by a pair of vertically extending pivot pins.

Figure 2:
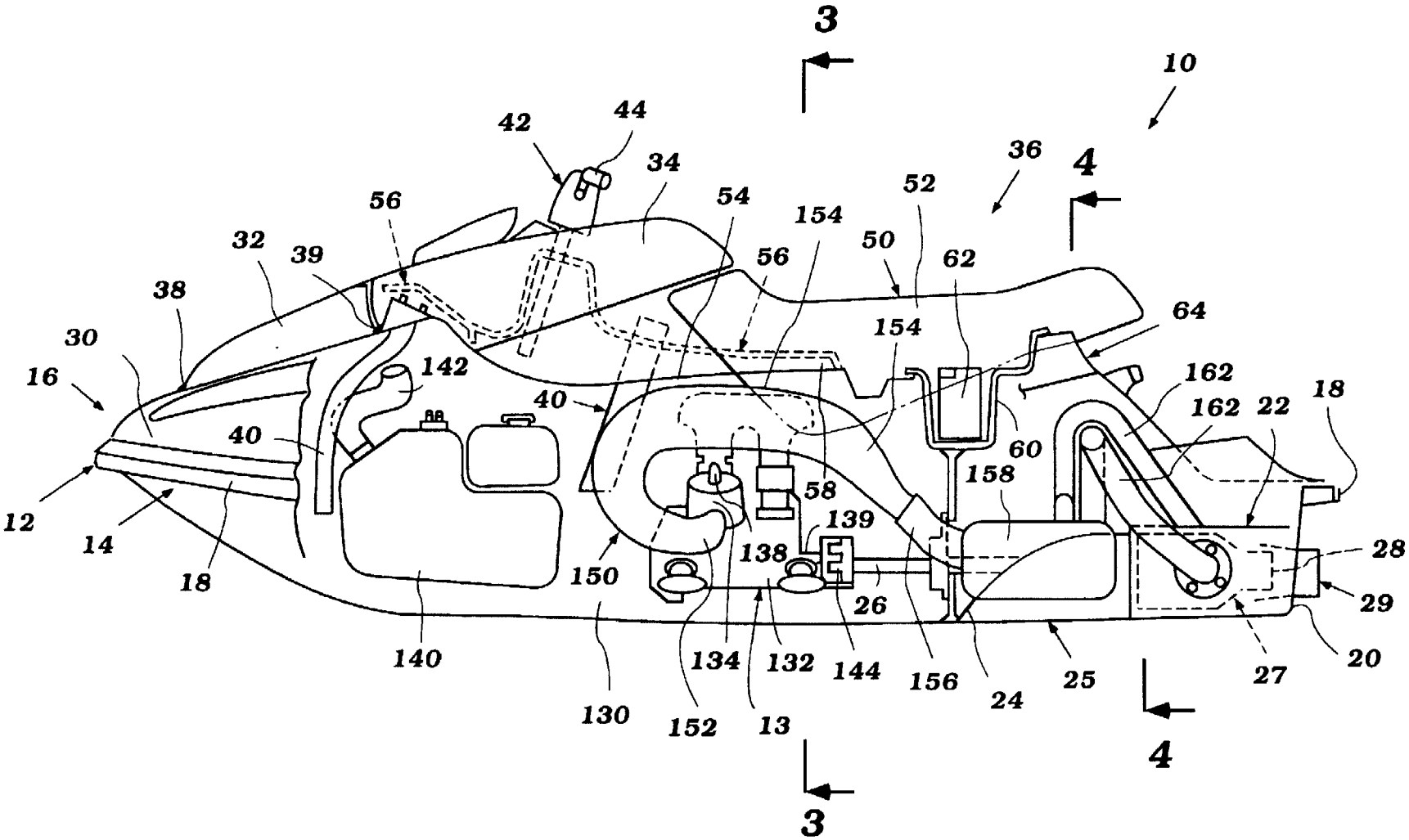
FIG. 2 is a partial sectional side elevational view of the personal watercraft of FIG. 1, showing the exhaust system of the watercraft engine.

With reference to FIGS. 1 and 2, the upper deck 16 comprises a bow deck 30 at a fore end of the watercraft 10. A bow hatch cover 32 of the upper deck 16 is positioned aft of and partially surrounded by the bow deck 30. An upper hatch cover 34 is located aft of the bow hatch cover 32 and in front of a rider's area 36.

As best seen from FIG. 2, the bow deck 30 slopes upwardly to the bow end of the bow hatch cover 32, at which point the cover 32 is connected to the bow deck 30 by a hinge 38. The hinge 38 allows the bow hatch cover 32 to swing upwardly and forward to provide access to storage space below.

The upper hatch cover 34 is similarly connected to the bow deck 30 by a hinge 39. One or more air supply pipes 40 extend from the bow deck 30 down into the interior of the hull 12. The upper hatch cover 34 desirably extends over the air supply pipes 40 to prevent water influx into the hull 12. A fuel supply port defined in the bow deck 30 is covered by a filler cap assembly 41 (FIG. 1).

The bow deck 30 and hatch covers 32, 34 slope upwardly to a control mast 42, which supports a handlebar assembly 44. The handlebar assembly 44 controls the steering of the watercraft 10 in a conventional manner, and includes a variety of controls such as, for example, a throttle control, a start switch, and lanyard switch.

Figure 5:
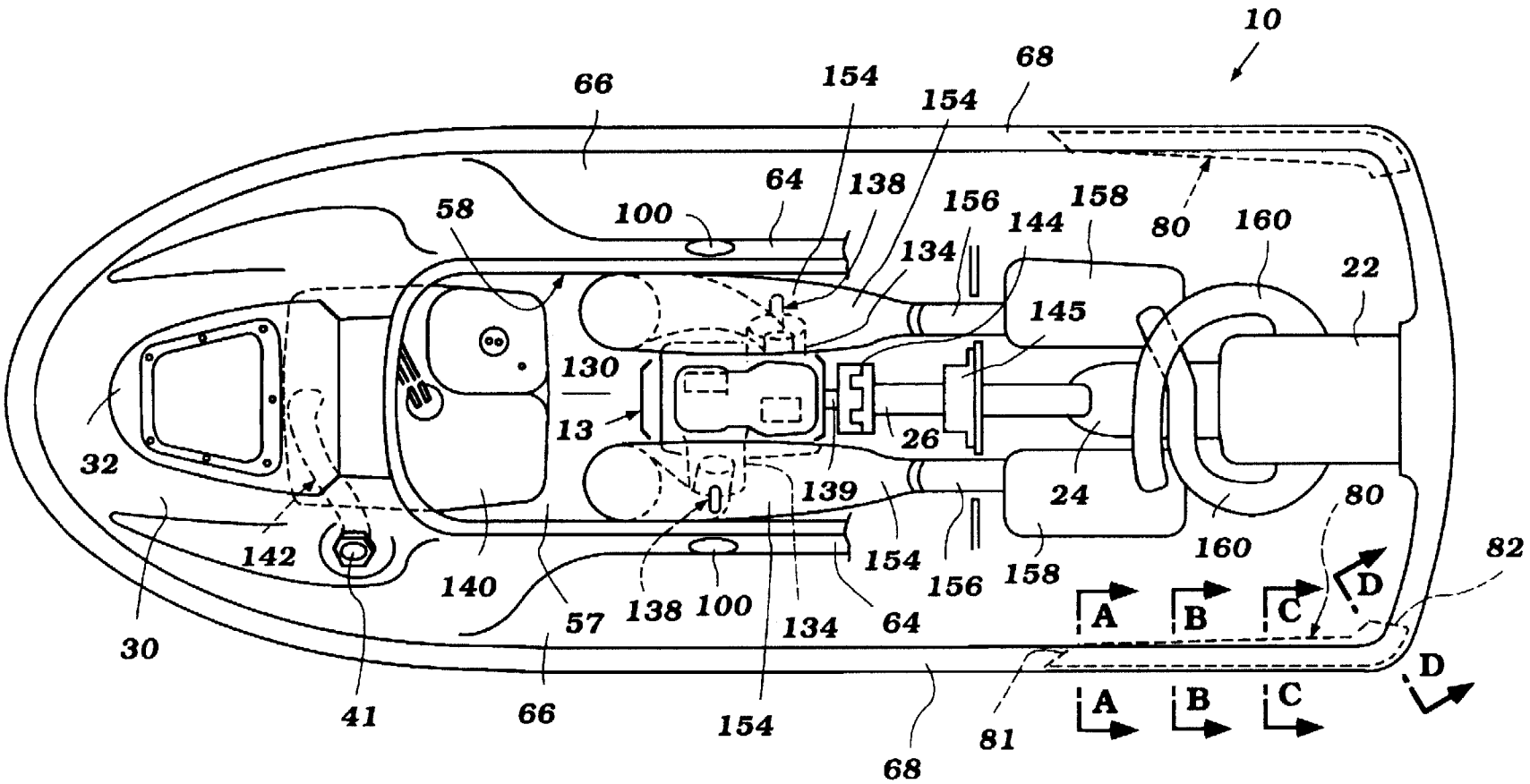
FIG. 5 is a partial sectional top plan view of the watercraft of FIG. 1 with the upper hatch cover and seat removed, and illustrates only a fore portion of the upper deck.
Figure 6A:
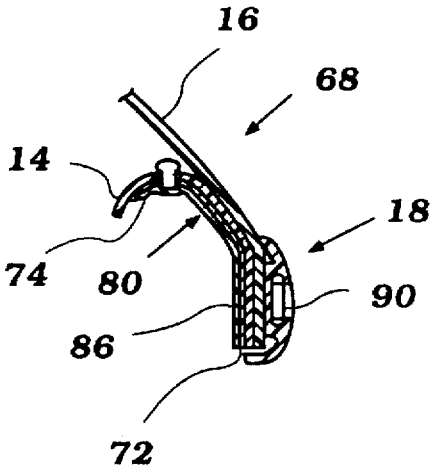
FIG. 6A is a sectional view of a portion of the personal watercraft of FIG. 5 along line A—A, illustrating an insert and the juncture of the upper deck and lower hull.
Figure 6B:
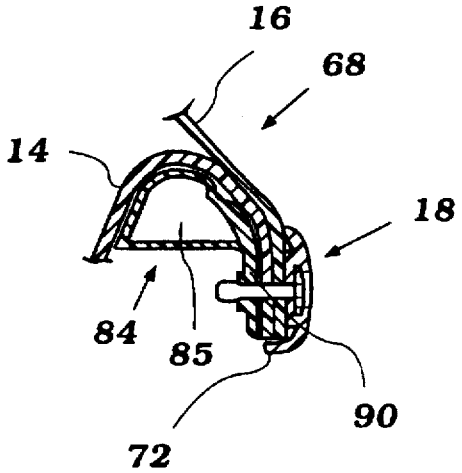
FIG. 6B is a sectional view of a portion of the personal watercraft of FIG. 5 along line B—B.
Figure 6C:
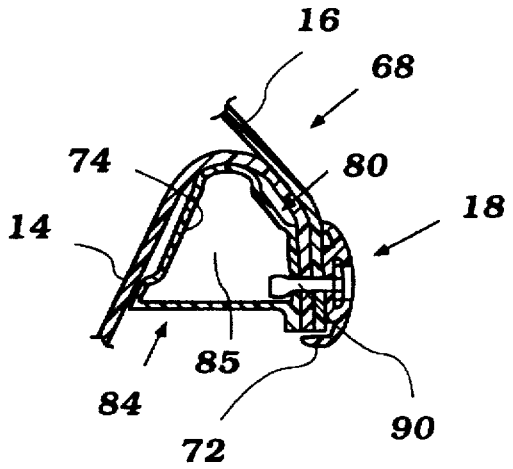
FIG. 6C is a sectional view of a portion of the personal watercraft of FIG. 5 along line C—C.
Figure 6D:
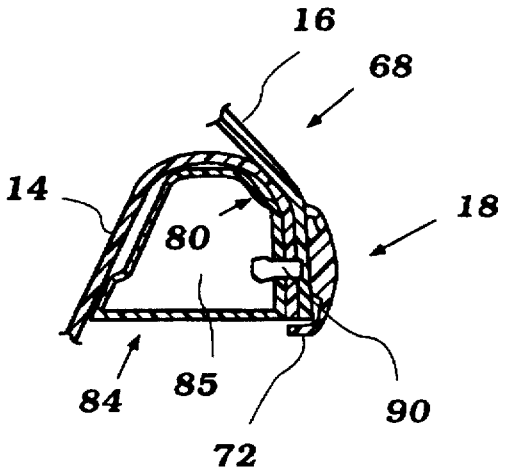
FIG. 6D is a sectional view of a portion of the personal watercraft of FIG. 5 along line D—D.

The rider's area 36 lies aft of the control mast 42 and includes a pedestal portion 50 of the upper deck 16. The pedestal 50 extends longitudinally along the center of the watercraft 10 in a shape that may be straddled by an operator and by at least one or two passengers. The pedestal supports a seat cushion 52, desirably comprised of a resilient material and shaped for rider and passenger comfort. A pedestal upper surface 54 is partially covered by the seat 52 and by a lower hatch cover 56 (FIG. 5). The lower hatch cover 56 is attached by bolts, for example, to the hinged upper hatch cover 34. The pedestal upper surface 54 includes a primary access opening or port 57 (more fully described below), defined by a hatch rim 58. The pedestal 50 also includes at least one storage compartment 60 below the seat 52. In the illustrated embodiment, the storage compartment 60 houses a battery 62 to provide power for start-up operation.

Figure 3:
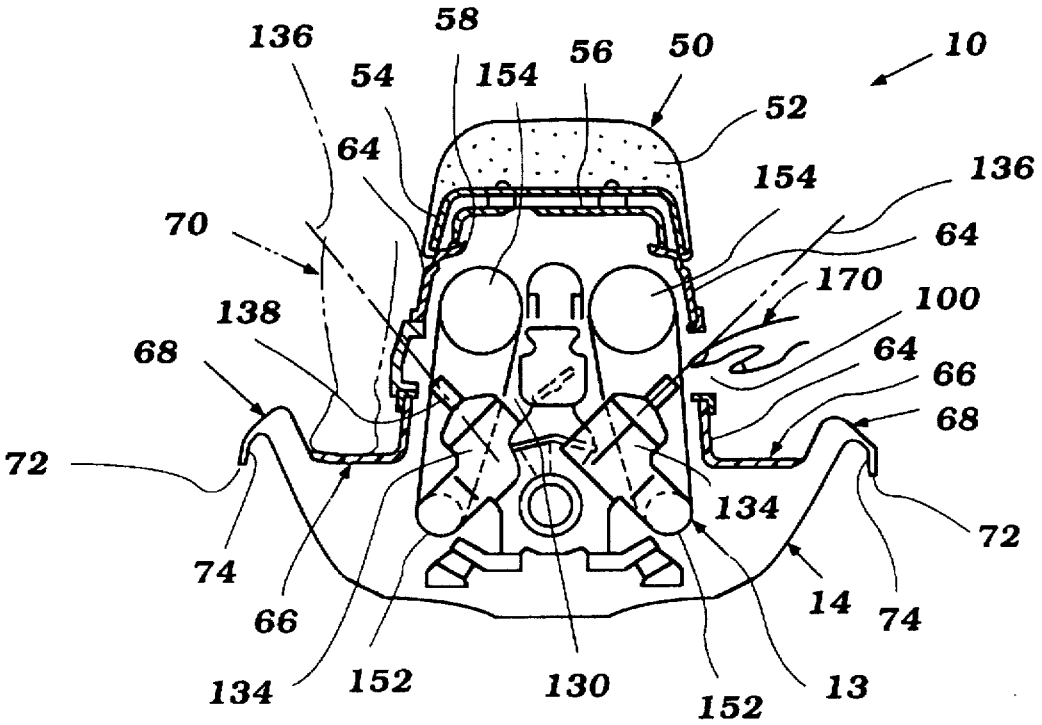
FIG. 3 is a sectional view of the personal watercraft along line 3—3 of FIG. 2.
Figure 4:
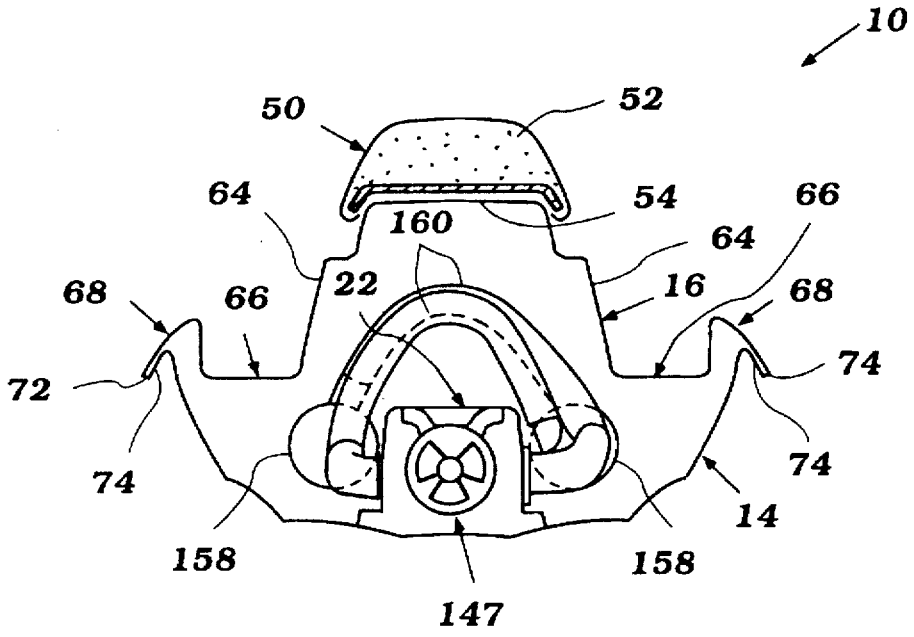
FIG. 4 is a sectional view of the personal watercraft along line 4—4 of FIG. 2.

As best seen from the views of FIGS. 3 and 4, the pedestal 50 comprises nearly vertical side walls 64 bridged by the pedestal upper surface 54. The seat cushion 52 is desirably removably attached to the pedestal upper surface 54. A pair of footrests 66, on either side of the pedestal 50, extend horizontally outwardly from the base of the pedestal side walls 64. A bulwark 68 rises vertically from the outer edge of each footrest 66. The upper surface of the bulwark 68 is defined by peripheral portions of the upper deck 16, while the lower surface of the bulwark is defined by peripheral portions of the lower hull 14. Each of the footrests 66 and the bulwarks 68 extend generally longitudinally and parallel to the pedestal side walls 64. The operator and any passengers sitting on the pedestal 50 can thus place their feet on the footrests 66 with the raised bulwarks 68 shielding lower legs 70 (FIG. 6) of the riders. A non-slip (e.g., rubber) mat desirably covers the footrests 66 to provide increased grip and traction for the operator and the passengers.

With reference still to FIGS. 3 and 4, the upper surface of the raised bulwark 68 rises to an apex before curving downward to an edge 72 of the hull 12. The apex of the bulwark 68 upper surface gently slopes upward toward the stern of the watercraft 10, as will be understood from a comparison of the views of FIGS. 3 and 4 (see also FIG. 1). The peripheral portion of the lower hull 14, forming the lower surface of the bulwark 68, follows a complementary curve to that of the upper deck 16, curving upwardly to an apex before also curving downward parallel to the upper deck 16. The lower hull 14 terminates at or near the edge 72. Both the lower hull 14 and the upper deck 16 extend vertically or almost vertically near the edge 72, forming the peripheral wall or gunnel 18. The underside of the bulwark 68 thereby forms a generally convex lip 74, which defines a recess opened at the bottom.

With reference to FIG. 5, the raised bulwark 68 and the lip on its underside (not shown in FIG. 5) extend around the periphery of the watercraft 10. A lip insert 80 extends along at least part of the periphery beneath the lip.

In the illustrated embodiment, two lip inserts 80 extend, on each of the port and starboard sides, from a fore end 81 to an aft end 82 along an aft portion of the periphery. Each of the illustrated lip inserts 80 extend approximately one quarter the length of the watercraft from the stern end of the watercraft.

As understood from FIGS. 6A to 6D and 7, the lip insert 80 of the illustrated embodiment comprises an elongated member substantially conforming to the lip 74 formed by the lower hull 14. Desirably, the insert 80 tapers from the aft end 82 to the fore end 81, such that a lower surface 84 slopes linearly and downward in the aft direction, as best seen from FIG. 7. The illustrated insert 80 comprises a hollow tubular construction defining an inner cavity 85, as may be provided by blow-molding plastic, for example. A flange 86 of the insert extends inside the gunnel 18, adjacent the lower hull 14 and the upper deck 16. Toward the aft end 81, the flange 86 is incorporated into the tubular member, aiding in defining the cavity 85. A bumper 88, comprising a resilient material such as rubber, extends along the outside surface of the gunnel 18, desirably curling around the hull edge 72.

In the illustrated embodiment, the insert flange 86, lower hull 14, upper hull 16, and bumper 88 are all attached to one another by stopper pins or rivets 90 extending through the gunnel 18, as illustrated, at periodic intervals along the gunnel 18. It will be understood by those skilled in the art that the stopper pins 90 may be replaced by adhesive resins or any other suitable method of attachment. Although not shown, an inner bumper strip may be fitted into a longitudinal recess along the bumper 88 to conceal the stopper pins 90 from view.

Each corresponding lip 74, insert 80 and inner portion of the lower hull 14 together define a channel. An open side of the channel faces downward and an upper surface of the channel slopes downward from a fore end of the channel to an aft end of the channel. In the illustrated embodiment, the upper surface of the channel is straight (i.e., is linear); however, the upper surface of the channel can have a curvilinear shape.

Figure 8:
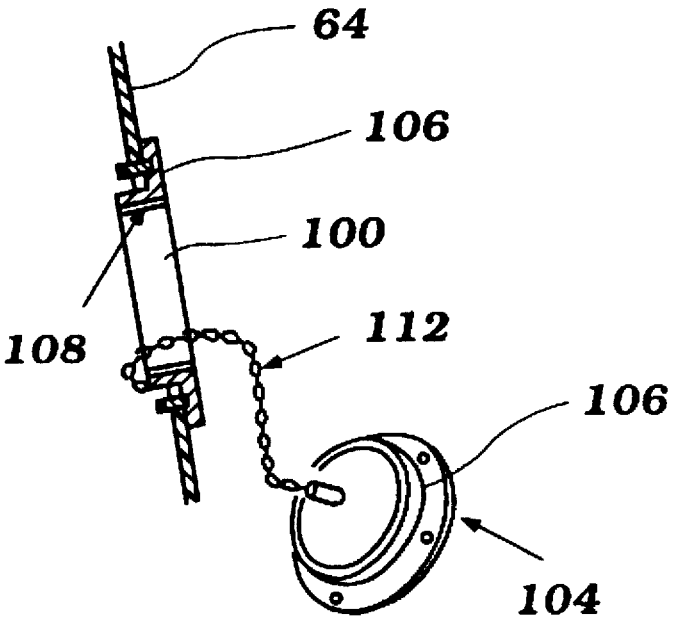
FIG. 8 is an enlarged partial sectional view of a pedestal sidewall of the personal watercraft of FIG. 1, illustrating an access opening and showing a removable access cover attached to the side wall by a chain.

With reference to FIGS. 1, 3 and 8, the hull 12 further includes at least one access opening or maintenance port 100. In the illustrated embodiment, the maintenance port 100 is located in the upper deck 16. Desirably, one maintenance port 100 is located in each pedestal sidewall 64. A maintenance port cap 104 removably engages with an annular maintenance port rim 106 affixed to the pedestal side walls 64, to reversibly cover and desirably seal the maintenance port 100. For example, as illustrated, the cap 104 may comprise an externally threaded surface 108 which engages a complementary internally threaded surface 110 of the rim 106. Desirably, the cap 104 is connected to the hull 12 to prevent loss of the cap 104 when removed from the port 100. In the illustrated embodiment, the cover 104 is connected to the maintenance port rim 106 by a chain 112.

The hull 12, as described hereto, defines an engine compartment 130 in which the engine 13 is housed. In the illustrated embodiment, the engine 13, is an internal combustion engine that powers a jet pump unit. The engine 13 is positioned within the engine compartment 130 and mounted on vibration-absorbing engine mounts, securing the engine 13 to the lower hull section 14 in a known manner.

In the illustrated embodiment, the engine 13 includes two cylinders in a V-configuration and operates on a two-stroke, crankcase compression principle. This type of engine is particularly desirable for use in a personal watercraft due to its relatively small size, high output, and balanced weight distribution. This engine is merely exemplary, however, and those skilled in the art will readily appreciate that the present improved hull can be adapted for use with a variety of engine types having other numbers of cylinders, having other cylinder arrangements, and/or operating on other combustion principles (e.g., four-stroke principle, in-line type arrangement, etc.).

A cylinder block 132 includes a pair of cylinder bores which define in part a pair of cylinders 134 protruding therefrom desirably define the cylinder bores of the engine. Each bore includes a cylinder liner. As noted, the cylinders 134 are desirably arranged in a V-configuration. Aspects of the invention have particular utility for the V-type engine 13 of the illustrated embodiment, as will be understood by one of skill in the art in light of the disclosure herein. The orientation of each cylinder 134 may be conveniently described with respect to cylinder axes 136. For the illustrated embodiment, the cylinder axes 136 define equal angles with the vertical, and desirably each axis 136 defines a 45° to the vertical.

A cylinder head is attached to an upper end of each cylinder bore to enclose the upper end. A recess in the cylinder head cooperates with the cylinder bore to complete the corresponding cylinder 134.

A spark plug 138 is removably attached, by any suitable means, to the cylinder head. Each spark plug 138 may be inserted or removed along an insertion axis. For example, each spark plug 138 of the illustrated embodiment is threadably inserted into a bore within each cylinder head assembly. In this case, the spark plug insertion axis coincides with or is parallel to the cylinder axis 136. It will be understood, however, that for other arrangements the insertion axis may not coincide with the cylinder axis. For example, the spark plug may slide into a bracket along an axis which is skewed in relation to the cylinder axis.

A piston reciprocates within each cylinder 134 along the cylinder axis 136 and together the pistons drive an output shaft 139, such as a crankshaft, in a known manner. A connecting rod links the corresponding piston to the crankshaft 139. The corresponding cylinder bore, piston and cylinder head of each cylinder 134 forms a variable-volume chamber, which at a minimum volume defines a combustion chamber.

The crankshaft 139 desirably is journalled within a crankcase, which in the illustrated embodiment is formed between a crankcase member and a lower end of the cylinder block 132. Individual crankcase chambers of the engine are formed within the crankcase by dividing walls and sealing disks, and are sealed from one another with each crankcase chamber communicating with a dedicated variable-volume chamber.

Each crankcase chamber also communicates with a charge former of an induction system through a check valve (e.g., a reed-type valve). The charge former of the illustrated embodiment is a conventional floatless type carburetor positioned in a valley formed between the cylinders 134. It will be understood, though, that other arrangements of the charge formers are possible. Other types of charge formers (e.g., fuel injectors) may also be used with the engine 13.

The charge formers of the induction system communicate with a fuel tank 140, which is positioned within the hull 12 in front of the engine 13. A fuel filler hose 142 extends between the filler cap assembly 41 (FIG. 1) and the fuel tank 140. In this manner, the fuel tank 140 can be filled from outside the hull 12, with the fuel passing through the fuel filler hose 142 into the fuel tank 140.

The induction system produces a fuel charge which is delivered to the cylinders in a known manner. Because the internal details of the engine 13 and the induction system can be conventional, a further description of the engine construction is not believed necessary to understand and practice the invention.

As seen in FIGS. 1 and 2, a coupling 144 interconnects the engine crankshaft 139 to the impeller shaft 26. A bearing assembly 145, which is secured to the bulkhead, supports the impeller shaft 26 behind the shaft coupling 144. The impeller shaft 26 extends through the impeller housing to the impeller 27 (FIG. 4) within the tunnel 22, as previously noted.

An exhaust system 150 is provided to discharge exhaust byproducts from each cylinder of the engine 13 to the atmosphere and/or to the body of water in which the watercraft 10 is operated. In the illustrated embodiment, the exhaust system 150 includes a pair of exhaust discharge pipes. Each pipe communicates with one of the cylinders to expel exhaust gases from the watercraft. The exhaust discharge pipes are symmetrically provided for the cylinders 134 on each of the starboard and port sides of the watercraft 10. The exhaust pipes on each side, in the illustrated embodiment, have identical construction and similar arrangements within the hull, the only difference being that the pipes on one side are arranged in the mirror image of each other. For this reason, the description below will generally refer only to one side of the exhaust system 150, unless otherwise noted.

The exhaust system 150 includes an exhaust manifold that is affixed to the side of the cylinder block 132 and which receives exhaust gases from the variable-volume chambers through exhaust ports in a well-known manner.

An outlet end of the exhaust manifold communicates with a C-shaped pipe section 152. This C-pipe 152 includes an inner tube that communicates directly with the discharge end of the exhaust manifold. An outer tube surrounds the inner tube to form a coolant jacket between the inner and outer tubes. Although not illustrated, the C-pipe 152 includes an inlet port positioned near its inlet end. The inlet port communicates with a water jacket of the engine 13.

The outlet end of the C-pipe 152 communicates with an expansion chamber 154. In the illustrated embodiment, the expansion chamber 154 has a tubular shape in which an expansion volume is defined within an annular, thick wall. Coolant jacket passages extend through the expansion chamber wall and communicate with the coolant jacket of the C-pipe 152.

A flexible coupling connects the outlet end of the C-pipe 152 to the inlet end of the expansion chamber 154. The flexible coupling also can include an outlet port which communicates with an internal coolant passage within the flexible coupling. The coolant passage places the coolant jacket and the coolant passages in communication.

The outlet end of the expansion chamber 154 is fixed to a reducer pipe which tapers in diameter toward its outlet. The pipe has a dual shell construction formed by an inner shell which defines an exhaust flow passage. The expansion volume communicates with this passage.

An outer shell is connected to the inner shell and defines a cooling jacket about the inner shell of the reducer pipe. The coolant jacket passages of the expansion chamber communicate with the coolant jacket of the pipe to discharge a portion of the coolant with the exhaust gases.

A catalyzer can be disposed within the space defined at the mating ends of the expansion chamber and the reducer pipe. For instance, the catalyzer can include an annular shell supporting a honeycomb-type catalyst bed. The catalyst bed is formed of a suitable catalytic material such as that desired to treat and render harmless hydrocarbons, carbon monoxide, and oxides of nitrogen. An annular flange supports the annular shell generally at the center of the flow path through the expansion chamber volume. In this manner, all exhaust gas flow through the expansion chamber 154 passes through the catalyst bed. The annular flange can be held between the outlet end of the expansion chamber and the inlet end of the reducer pipe.

The lower section of the reducer pipe includes a downward turned portion that terminates at the discharge end. The inner shell stops short of the outer shell such that the water flow through the water jacket merges with the exhaust gas flow through the exhaust passage at the discharge end.

A flexible pipe 156 is connected to the discharge end of the reducer pipe and extends rearward along one side of the watercraft hull tunnel 22. The flexible conduit 50 connects to an inlet section of a water trap device 158. The water trap devices 158 also lies within the watercraft hull 12 on one side of the tunnel 22.

The water trap device 158 has a sufficient volume to retain water and to preclude the back flow of water to the expansion chamber 154 and the engine 13. Internal baffles within the water trap device 158 help control water flow through the exhaust system 150.

A downstream exhaust pipe 160 extends from an outlet section of the water trap device 158 to a discharge end. The discharge end desirably opens into the tunnel 22 at an area that is close to or actually below the water level when the watercraft 10 is floating at rest on the body of water.

The engine 13 is mounted within the engine compartment 130 defined by the hull, proximate the primary access port 57. It will be understood that the primary access port 57 will generally be large enough and close enough to the engine 13 to allow a mechanic to reach many, if not most, engine components for servicing. Access for such servicing should be available through the primary access port 57 without requiring separation of the upper deck 16 from the lower hull 14.

For purposes of the following description, the axis of an access port can be determined by forming a perpendicular line to a plane connecting hull edges which define the port. In the illustrated embodiment, the primary access port 57 is defined by the hatch rim 58, as best understood from FIG. 5, such that primary access port 57 has a generally vertical axis. The engine compartment 130 of the illustrated embodiment is defined at least partially below the removable seat cushion 52, since the primary access port 57 at least partially underlies the seat 52.

The maintenance port 100 is arranged to facilitate access to certain engine components. For example, the maintenance port 100 of the illustrated embodiment provides access to the engine at a different angle from the axis of the primary access port 57. Desirably, the maintenance port 100 has an axis which diverges from the axis of the primary access port 57 by greater than 30°, and more desirably by greater than about 45°. The axis of the maintenance port 100 of illustrated embodiment diverges from the axis of the primary access port 57 by between about 80° and 90°.

The maintenance port 100 may also facilitate access due to a closer proximity to certain engine components, relative to the proximity through the primary access port 57. For example, the position of each maintenance port 100 of the illustrated embodiment is selected to place the port 100 in proximity to one of the spark plugs 138, close enough to reach the plugs 138 with the appropriate tool.

The maintenance port 100 may also facilitate access by more providing suitable alignment of the port 100 with a component movement which is desired for maintenance. "Suitable alignment" or "suitably aligned," as utilized in this connection, refers to alignment of the maintenance port axis with a desired movement of the component (e.g., or removing the spark along the cylinder axis). It will be understood, of course, that the degree of alignment which is suitable will depend upon the proximity of the maintenance port to the engine component to be serviced, but generally the maintenance port axis should be within about 90° of parallel to the desired movement. Desirably, the maintenance port axis is aligned within about 60° of parallel, and more desirably within about 45° of parallel, to the desired movement. As best seen from FIG. 3, the illustrated maintenance port 100 is aligned within about 30° of parallel to the insertion axis 136 associated with the spark plug 138 and cylinder head assembly (as well as the cylinder axis).

As best seen from FIG. 2, the fuel tank 140 of the illustrated embodiment is located to the fore of the engine compartment 130. The C-pipe 152 of each exhaust system 150 (starboard and port) is connected at an upstream end to the engine 13 within the engine compartment 130. In the illustrated embodiment, the exhaust expansion chamber 154 is also found within the engine compartment 130. The exhaust system 150 extends from the expansion chamber 154 to the flexible pipe 156 and thence to the water trap 158, illustrated as aft of the engine compartment 130. It will be understood, however, that for other arrangements, the relative positions of the fuel tank, engine compartment, and components of the exhaust system may be other than that illustrated without departing from the spirit of the invention.

In the embodiment illustrated in FIGS. 1 to 8, the exhaust system 150 of each cylinder 134 remains on the side of that cylinder, up to but not including the downstream exhaust pipes 160. The exhaust pipes 160 cross over before emptying into the tunnel 22. The C-pipe 152 of each exhaust system 150 curves upwardly away from the cylinder 134, such that the exhaust expansion chamber 154 passes over the cylinder 134 as it extends aftward. Accordingly, as best understood from the view of FIG. 5, access to the spark plugs 138 from the primary access port 57 is obstructed by the exhaust expansion chambers 154 overlying each cylinder 134. While access to the spark plugs 138 through the primary access port 57 is obstructed, this arrangement is advantageous in making efficient use of the space available within the engine compartment 130, as dictated by the ergonomic design of the pedestal 50, without having to widen the engine compartment 130. The secondary access port 100 enables this efficient use of space by providing the required access to the spark plugs 138.

Figure 9:
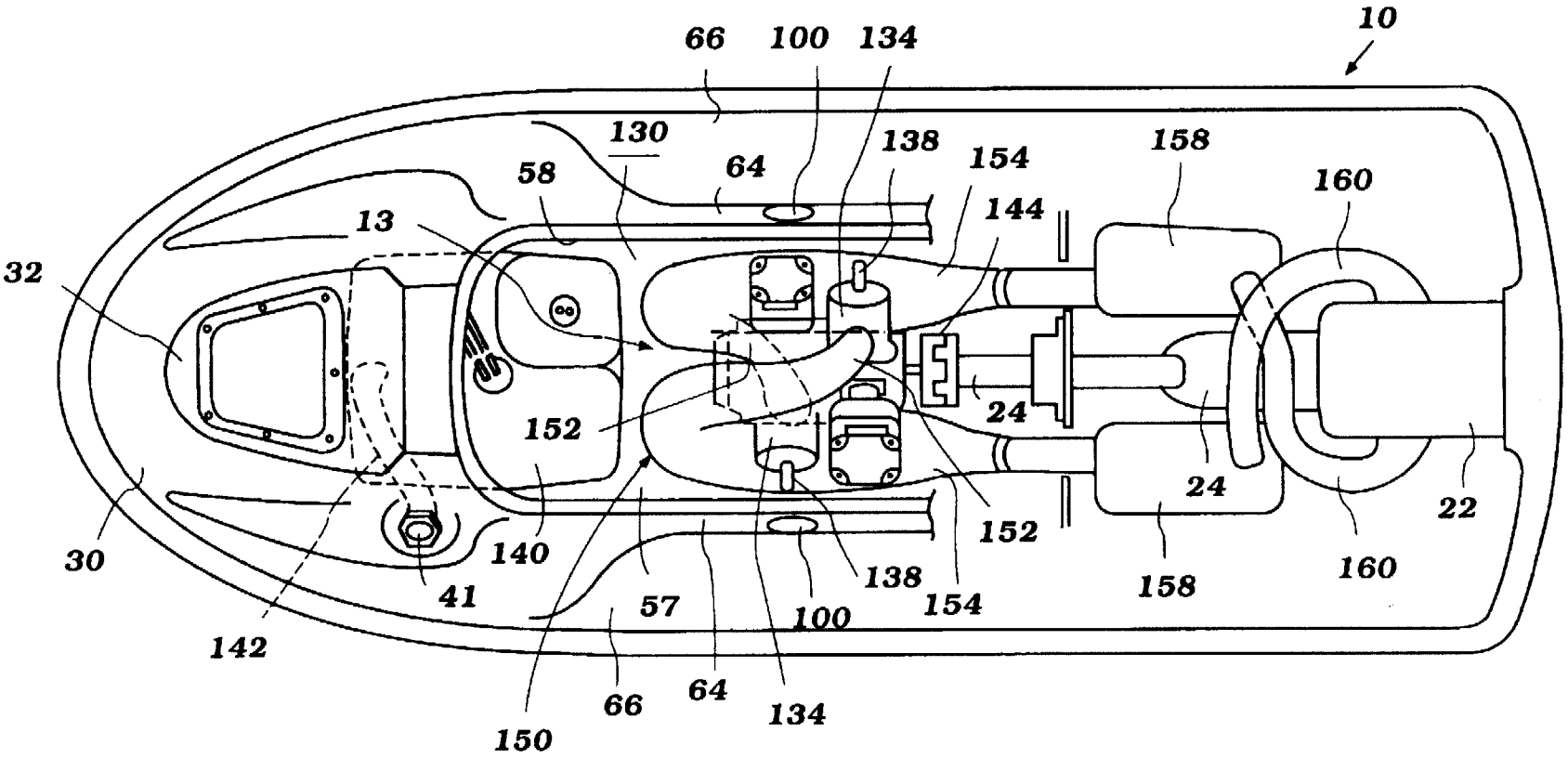
FIG. 9 is a partial sectional top plan view of a personal watercraft, similar to that illustrated in FIG. 5, but with an exhaust system configured in accordance with another preferred embodiment of the present invention.

With reference to FIG. 2, in order to gain access to the engine 13 through the primary access port 57 of the illustrated watercraft 10 for maintenance or service purposes, the seat cushion 52 is first removed. The upper hatch cover 34 and lower hatch cover 56 bolted thereto may be pivotally swung open about the hinge 39. The primary access opening, as defined by the hatch rim 58, is thus revealed, as illustrated in FIGS. 5 and 9. Access to certain areas of the engine compartment 130, including components of the engine 13, however, is obstructed or made more difficult by interference of other components (e.g., exhaust expansion chamber 154), and by the distance and/or angle of approach through the primary access opening.

Access to such obscured, remote, or angled engine components may be facilitated by the maintenance ports 100 of the illustrated embodiments, which may serve as a secondary access port to the engine compartment 130. The illustrated maintenance port cap 104 may be rotated to disengage the threaded cap surface 106 from the threaded rim surface 108 (see FIG. 8). The spark plugs 138 of the illustrated embodiments are exemplary components within the engine compartment 130 to which access is desirable. It will be understood, however, that the maintenance ports 100 may facilitate access to other engine components. For example, if the engine 13 is carbureted, the maintenance port may provide access to at least one carburetor adjustment screw, which would require relatively frequent adjustment.

Figure 10:
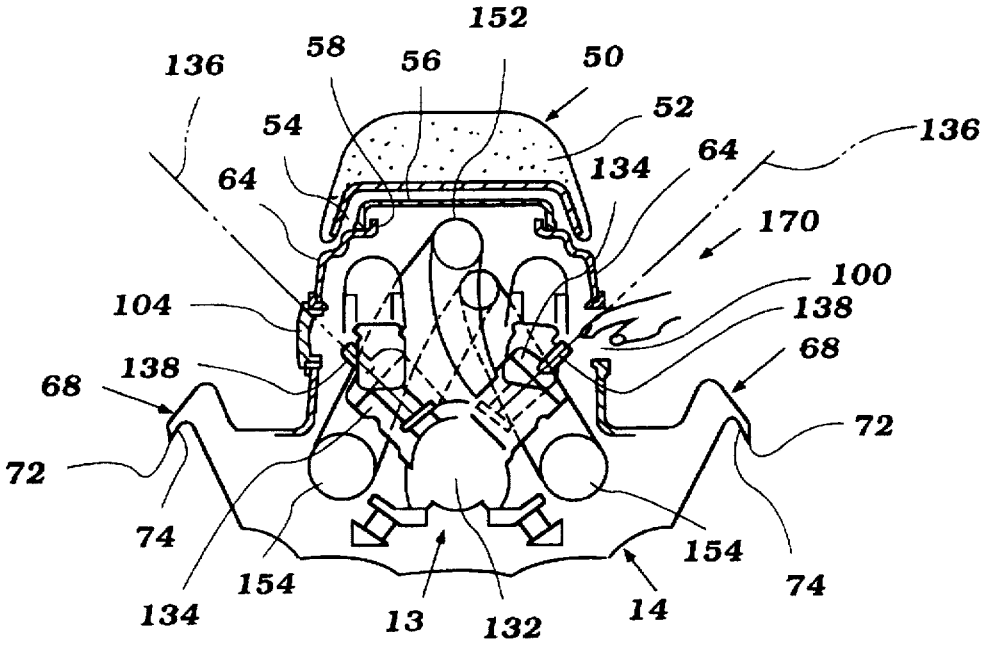
FIG. 10 is a sectional view of the personal watercraft of FIG. 9, from a similar to that of FIG. 3.
Figure 11:
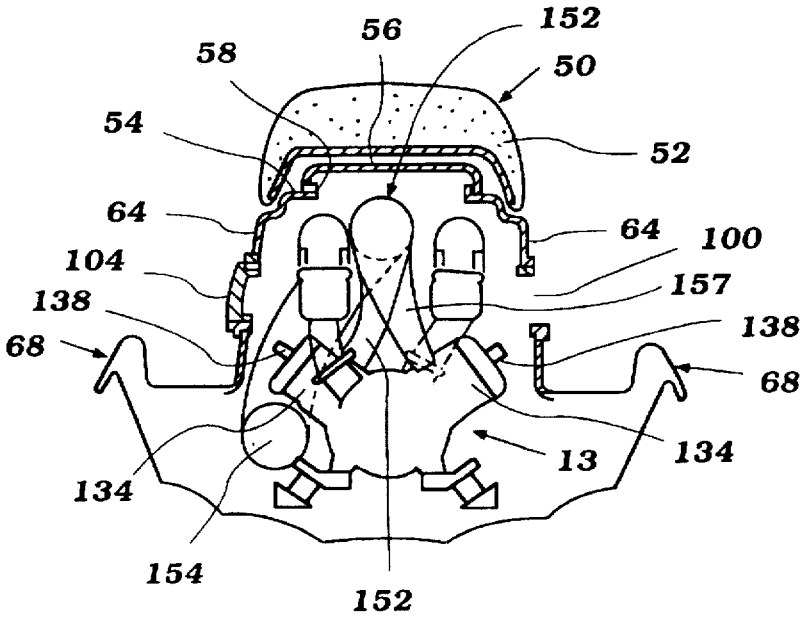
FIG. 11 is a sectional view of the personal watercraft of FIG. 9, from a similar view to that of FIG. 4.
Figure 12:
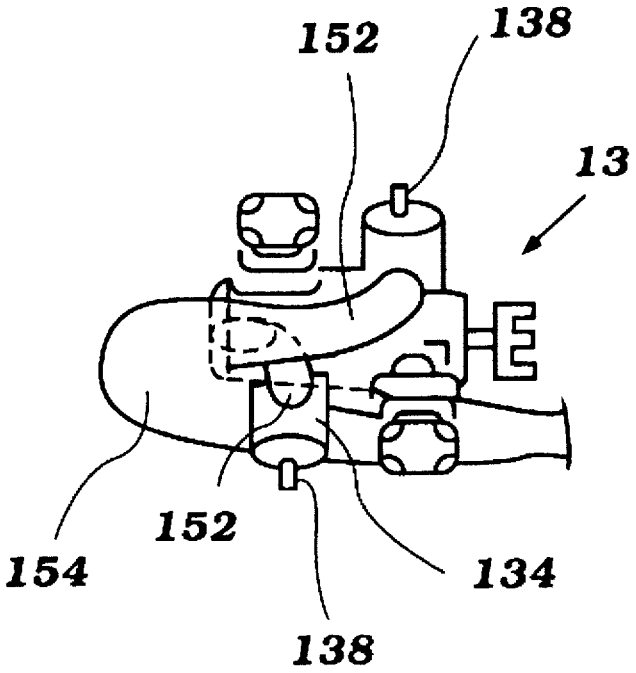
FIG. 12 is an enlarged view of a portion of the engine and the exhaust system of the personal watercraft of FIG. 9.

In accordance with the illustrated embodiment, the spark plugs 138 are located proximate the maintenance ports 100, as compared to the distance to primary access port 57 below the seat 52. Furthermore, the maintenance ports 100 extend through the pedestal side walls 64 and, accordingly, are more suitably angled for removal/insertion of spark plugs into the V-configured cylinders 134 of the illustrated engine 13. As best seen from the views of FIGS. 3 and 10, an operator's hand 170 may gain access to the plugs 138 with relative ease, whether the exhaust expansion chamber wraps above (FIG. 3) or below (FIG. 10) the cylinders 134.

Removal/insertion of the spark plug 138 from the cylinder head assembly of the illustrated embodiment involves two separate types of motion. For removal, for example, the first motion is counterclockwise rotational, which is movement is facilitated by the proximity of the maintenance port 100 to the plug 138. The second motion required is along the cylinder axis 136, which occurs while unscrewing the plug 138, as well as while drawing the unscrewed plug away from the cylinder. The opposite motions are required to insert a new spark plug 138. The maintenance port cap 104 may be replaced after maintenance, to inhibit water intake during operation.

When operating the watercraft 10 in a body of water, the operator may control the fuel throttle by adjustment of controls supported by the control mast 42, the engine 13 drives the impeller shaft 26, which in turn drives the impeller 27 within the tunnel 22. Water is drawn through the inlet port 26, into the tunnel 22 and through the discharge nozzle 28, thereby propelling the watercraft 10 forward. The rider may the control direction of travel by moving the handlebar assembly, which controls the steering nozzle 29.

Figure 7:
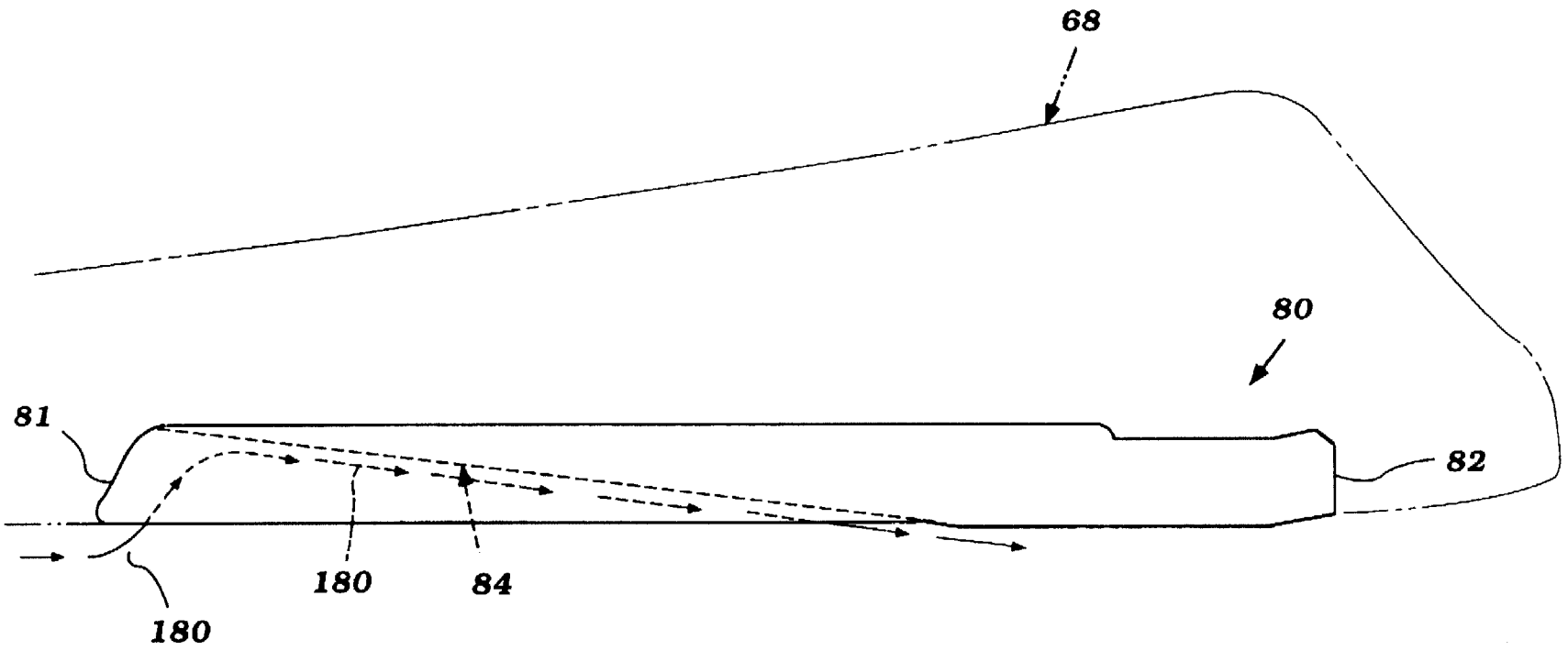
FIG. 7 is an enlarged partial sectional view of a rear portion of the upper deck of the watercraft of the FIG. 1, illustrating the insert at the juncture of the upper deck and the lower hull.

At rest, the stern of the watercraft 10, including the aft portion of the lip 74, is submerged in the body of water surrounding the watercraft 10. With reference to FIG. 7, during initial forward motion, water flows longitudinally within the recess defined by the lip 74 from the forward motion of the watercraft 10. The direction of flow is represented generally by arrows 180 in FIG. 7. The sloping lower surface 84 of the lip insert 80 forces the flowing water into a relatively more downward direction, as illustrated. The force of the downward component of the water flow 180 causes an upward force on the insert 80 in reaction. This upward force aids in bringing the watercraft 10 up on plane more swiftly, relative to a watercraft without the insert. The watercraft 10 also experiences less drag with the insert filling the aft portion of the recess. Accordingly, the watercraft 10 with the lip insert 80 may accelerate more quickly from rest, relative to prior watercraft.

During high speed operation, sharp turns also tend to submerge the lip 74 on the side of the watercraft 10 inside the turn. As with start-up operation, water tends to flow inside the recess defined by the lip 74, except that the water flows on only one side of the watercraft 10. In this situation, the lip insert 80 forces water out of the recess and prevents water from flowing into the portion of the recess on the aft end of the watercraft 10. Accordingly, the lip insert 80 reduces drag on the watercraft during sharp turns.

FIGS. 9 to 12 illustrate another embodiment of the present invention. In the drawings as well as the present description, like numerals are utilized to refer to elements having like functions, to aid the reader's understanding. For this embodiment, the C-pipe 152 of each exhaust system 150 crosses over to the opposite side of the watercraft 10, while curving downward. In this case, the exhaust expansion chamber 154 passes under each cylinder 134 as the exhaust system 150 extends aftward. While in this case the exhaust expansion chambers 154 do not obstruct direct access to the spark plugs 138, removal or insertion of the spark plugs is nevertheless difficult due to the angle of the insertion axis 136 as well as the proximity of the spark plugs 138 to the pedestal side walls 64. Like the arrangement of the embodiment of FIGS. 1 to 8, this arrangement is similarly efficient in making use of available space without having to widen the engine compartment 130.

Although this invention has been described in terms of certain preferred embodiments, other embodiments apparent to those of ordinary skill in the art are also within the scope of this invention. For example, for other arrangements, a secondary access port may facilitate access to engine components other than or in addition to spark plugs. Accordingly, the scope of the invention is intended to be defined only by the claims that follow.

What is claimed is:

1. A small watercraft comprising a hull, said hull including at least two footrests positioned on either side of a pedestal located in a rider area, the pedestal comprising two side walls bridged by a seat, said hull defining an enclosed space below the seat, at least one of said pedestal side walls having a maintenance port therein communicating with the enclosed space to provide access to the enclosed space.

2. The small watercraft of claim 1, further comprising an engine housed within said enclosed space.

3. The small watercraft of claim 2, wherein said maintenance port communicates with said enclosed space proximate said engine.

4. The small watercraft of claim 3, wherein said maintenance port communicates with said enclosed space proximate a spark plug of said engine.

5. The small watercraft of claim 2, wherein said hull further comprises a primary access port communicating with said enclosed space.

6. The small watercraft of claim 5, wherein said primary access port is positioned to extend through an upper surface of said hull.

7. The small watercraft of claim 6 wherein said primary access port is at least partially removably covered by said seat.

8. The small watercraft of claim 7, further comprising an exhaust system communicating with said engine, wherein a portion of said exhaust system is interposed between said seat and at least one engine component.

9. The small watercraft of claim 8, wherein said engine component comprises a spark plug.

10. The small watercraft of claim 2, further comprising an exhaust system communicating with said engine, wherein a portion of said exhaust system is positioned below a cylinder of said engine.

11. The small watercraft of claim 2, wherein said engine has a plurality of cylinders arranged in a V-configuration.

12. The small watercraft of claim 1, wherein each of said pedestal side walls is connected to one of said footrests.

13. A small watercraft comprising a hull defining an engine compartment, and an internal combustion engine housed within said engine compartment, the engine including an engine body and at least one spark plug removably attached to said engine body and movable along a plug insertion axis, the hull including at least first and second maintenance ports communicating with said engine compartment, said first maintenance port being proximate to said spark plug and having a maintenance port axis suitably aligned with said plug insertion axis, and said second maintenance port being positioned above the engine and having a maintenance port axis which is skewed relative to the maintenance port axis of said first maintenance port.

14. The small watercraft of claim 13, wherein said internal combustion engine has a V-configuration.

15. The small watercraft of claim 13, wherein said maintenance port axis diverges from said plug insertion axis by no more than about 90°.

16. The small watercraft of claim 13, wherein said maintenance port axis diverges from said plug insertion axis by no more than about 45°.

17. The small watercraft of claim 13, wherein said first maintenance port is positioned on a side wall of said hull.

18. A small watercraft comprising a hull defining an engine compartment, and an internal combustion engine housed within said engine compartment, the engine including an engine body and at least one spark plug removably attached to said engine body and movable along a plug insertion axis, the hull including a maintenance port communicating with said engine compartment proximate to said spark plug and having a maintenance port axis suitably aligned with said plug insertion axis, said maintenance port being positioned on a side wall of said hull.

19. A small watercraft comprising a hull defining an engine compartment, an engine housed within said engine compartment, said hull comprising a primary access port being in communication with said engine compartment and having a primary port axis, and a secondary access port being in communication with the engine compartment and having characterized by a secondary port axis, said secondary port axis oriented non-parallel to said primary port axis.

20. The small watercraft of claim 19, wherein said hull further comprises an upper hatch covering at least in part said primary access port.

21. The small watercraft of claim 19, wherein said primary access port is at least partially covered by a removable seat.

22. The small watercraft of claim 19, wherein said secondary access port is positioned in a side wall of said hull.

23. The small watercraft of claim 19, wherein said hull further comprises a secondary access port cap removably covering said secondary access port.

24. The small watercraft of claim 19, wherein said secondary port axis diverges from said primary port axis by greater than about 45°.

25. The small watercraft of claim 19, wherein said secondary port axis diverges from said primary port axis by between about 80° and 90°.

26. A small watercraft comprising a hull having a bow portion and a stern portion, at least the stern portion of the hull including a convex lip defining a downward-facing open recess and at least one lip insert positioned at least partially within at least a portion of said recess.

27. The small watercraft of claim 26, wherein said lip is formed at a joint of an upper deck portion and lower hull portion of said hull.

28. The small watercraft of claim 26, wherein said lip insert extends toward the bow portion from an aft end of the stern portion of said hull.

29. The small watercraft of claim 26, wherein said lip insert comprises a downward sloping lower surface.

30. The small watercraft of claim 26, wherein said lip insert tapers in thickness toward a fore end such that said recess becomes more shallow toward an aft end.

31. The small watercraft of claim 30, wherein said recess extends about the entire periphery of the stern portion of the hull.

32. The small watercraft of claim 30 additionally comprising another said lip insert, said lip inserts being arranged within said recess on opposite sides of said hull.

33. A small motorized watercraft comprising a hull including at least one side edge, said side edge defining at least in part a downward-facing channel, at least a tapered portion of channel being tapered from a fore end to a relatively more shallow aft end.

34. The small motorized watercraft of claim 33, wherein said tapered portion of said channel extends about one quarter the length of the watercraft.

35. The small motorized watercraft of claim 33, wherein said tapered portion of said channel extends along said side edge hull to an aft end of the hull.

36. The small motorized watercraft of claim 33, wherein said side edge forms part of a bulwark of said hull.

37. The small motorized watercraft of claim 33, wherein said hull comprises another side edge that defines at least in part another downward facing channel, the another channel having at least a tapered portion that tapers from a fore and to a relatively more shallow aft end, and the another side edge being arranged such that said tapered portions of the channels lie on opposite sides of the hull.

38. The small motorized watercraft of claim 33, wherein said tapered portion of said channel has a linear shape from fore to aft end.

* * * * *